US008912986B2

(12) United States Patent
Yamano et al.

(10) Patent No.: US 8,912,986 B2
(45) Date of Patent: Dec. 16, 2014

(54) DISPLAY CONTROL DEVICE, DISPLAY CONTROL METHOD, AND COMPUTER PROGRAM

(75) Inventors: Ikuo Yamano, Tokyo (JP); Yasushi Okumura, Tokyo (JP); Takuro Noda, Tokyo (JP); Qihong Wang, Tokyo (JP)

(73) Assignee: Sony Corporation (JP)

( * ) Notice: Subject to any disclaimer, the term of this patent is extended or adjusted under 35 U.S.C. 154(b) by 197 days.

(21) Appl. No.: 13/535,611

(22) Filed: Jun. 28, 2012

(65) Prior Publication Data

US 2013/0009921 A1 Jan. 10, 2013

(30) Foreign Application Priority Data

Jul. 6, 2011 (JP) ..... 2011-150377

(51) Int. Cl.
*G09G 3/30* (2006.01)
*G09G 3/20* (2006.01)

(52) U.S. Cl.
CPC ..... *G09G 3/20* (2013.01); *G09G 2320/10* (2013.01); *G09G 2340/125* (2013.01); *G09G 2300/023* (2013.01); *G09G 2380/14* (2013.01); *G09G 2310/04* (2013.01); *G09G 2330/021* (2013.01)
USPC ..... 345/76; 345/173; 345/204

(58) Field of Classification Search
CPC ..... G09G 2300/023; G09G 2310/04; G09G 2320/10; G09G 2340/125; G09G 2380/14
USPC ..... 345/173, 76, 204
See application file for complete search history.

(56) References Cited

U.S. PATENT DOCUMENTS

| | | | | |
|---|---|---|---|---|
| 7,205,959 | B2 * | 4/2007 | Henriksson | 345/4 |
| 8,063,887 | B2 | 11/2011 | Barrus et al. | |
| 2006/0061530 | A1 * | 3/2006 | Yuasa | 345/88 |
| 2008/0192013 | A1 * | 8/2008 | Barrus et al. | 345/173 |
| 2011/0157326 | A1 * | 6/2011 | Karaoguz et al. | 348/51 |
| 2012/0032972 | A1 * | 2/2012 | Hwang | 345/592 |

FOREIGN PATENT DOCUMENTS

JP 2008-197634 A 8/2008

* cited by examiner

*Primary Examiner* — Viet Pham
(74) *Attorney, Agent, or Firm* — Lerner, David, Littenberg, Krumholz & Mentlik, LLP

(57) ABSTRACT

A display control device includes: a display control unit that controls display of a reflective first display member and a self-emitting second display member that is provided in superimposition on a display surface of the first display member, has higher rewriting responsiveness than that of the first display member, and may transmit display of the first display member, wherein, when predetermined information is displayed on the first display member and the second display member, the display control unit performs predetermined display control on the first display member in an area corresponding to an area in which the second display member displays information or on the second display member in an area corresponding to an area in which the first display member displays information.

11 Claims, 14 Drawing Sheets

DISPLAY CONTROL DEVICE, DISPLAY CONTROL METHOD, AND COMPUTER PROGRAM

CROSS-REFERENCE TO RELATED APPLICATION

The present application claims priority from Japanese Patent Application No. JP 2011-150377 filed in the Japanese Patent Office on Jul. 6, 2011, the entire content of which is incorporated herein by reference.

FIELD

The present disclosure relates to a display control device, a display control method, and a computer program.

BACKGROUND

Recently, information media called electronic paper have increasingly attracted attention (for example, see Patent Document 1 (JP-A-2008-197634)). The electronic paper has advantageous properties of low power consumption and bendable flexibility, and further, thinness, lightness, and high visual recognition. Furthermore, the electronic paper has a remarkable feature of rewritability.

The above described electronic paper can hold an image once displayed without energy consumption. Therefore, the electronic paper can be applied to limited use for displaying an image of a poster, an ad on the train, an indicator indicating remaining battery capacity, and an information board indicating a destination, or the like. Further, recently, the electronic paper has been increasingly applied to an electronic terminal that displays electronic books.

SUMMARY

There has been a problem that the above described electronic paper has low rewriting responsiveness and is unsuitable for display of moving images and animations, interactive representation of GUI, or the like. Accordingly, Patent Document 1 discloses a technology of superimposing a transparent display on a paper-like display that operates with lower power like electronic paper and displaying a static image on the paper-like display and a dynamic image on the transparent display.

However, in Patent Document 1, there is no description of control when a video is displayed by the transparent display superimposed on the paper-like display. Specifically, in the case where an organic light-emitting diode (OLED) display is used as the transparent display, the OLED is incapable of displaying in black and therefore unsuitable for high contrast display.

It is therefore desirable to provide new and improved display control device, display control method, and computer program that display, with high contrast, of moving images and animations, interactive representation of GUI (Graphical User Interface), or the like in a display apparatus in which a transparent display member having high rewriting responsiveness superimposed on a reflective display member having inferior rewriting responsiveness like electronic paper.

An embodiment of the present disclosure is directed to a display control device including a display control unit that controls display of a sheet-like first display member and a self-emitting second display member that is provided in superimposition on a display surface of the first display member and may transmit display of the first display member, wherein, when predetermined information is displayed on the first display member and the second display member, the display control unit performs predetermined display control on the first display member in an area corresponding to an area in which the second display member displays information or on the second display member in an area corresponding to an area in which the first display member displays information.

According to the embodiment of the present disclosure, the display control unit controls display of the sheet-like first display member and the self-emitting second display member that is provided in superimposition on the display surface of the first display member and may transmit display of the first display member. For control, when predetermined information is displayed on the first display member and the second display member, the display control unit performs predetermined display control on the first display member in the area corresponding to the area in which the second display member displays information or on the second display member in the area corresponding to the area in which the first display member displays information. Thereby, display of moving images, display of animations, interactive representation of GUI, or the like may be displayed with high contrast in a display apparatus in which, on the reflective display member having inferior rewriting responsiveness, a display member having high rewriting responsiveness that may transmit display of the reflective display member is superimposed.

Another embodiment of the present disclosure is directed to a display control method including controlling display of a sheet-like first display member and a self-emitting second display member that is provided in superimposition on a display surface of the first display member and may transmit display of the first display member, wherein, when predetermined information is displayed on the second display member, the display control step performs predetermined display control on the first display member in an area corresponding to an area in which the second display member displays information.

Still another embodiment of the present disclosure is directed to a computer program allowing a computer to execute a display control step, in a display apparatus including a sheet-like first display member and a self-emitting second display member that is provided in superimposition on a display surface of the first display member and may transmit display of the first display member, when predetermined information is displayed on the second member, of performing predetermined display control on the first display member in an area corresponding to an area in which the second display member displays information.

As explained above, according to the embodiments of the present disclosure, there may be new and improved display control device, display control method, and computer program that display of moving images, animations, interactive representation of GUI, or the like by superimposing a transparent display member having high rewriting responsiveness on a display member having flexibility like electronic paper.

DETAILED DESCRIPTION

Hereinafter, preferred embodiments of the present disclosure will be explained in detail with reference to the accompanying drawings. In the specification and the drawings, the same signs are assigned to the component elements having substantially the same functional configurations, and their duplicated explanation will be omitted.

The explanation will be made in the following order.

<1. One Embodiment of the Present Disclosure>

[1-1. Appearance of Display Apparatus]

[1-2. Functional Configuration of Display Apparatus]

[1-3. Operation of Display Apparatus]

<2. Conclusion>

<1. One Embodiment of the Present Disclosure>

[1-1. Appearance of Display Apparatus]

Figure 1:
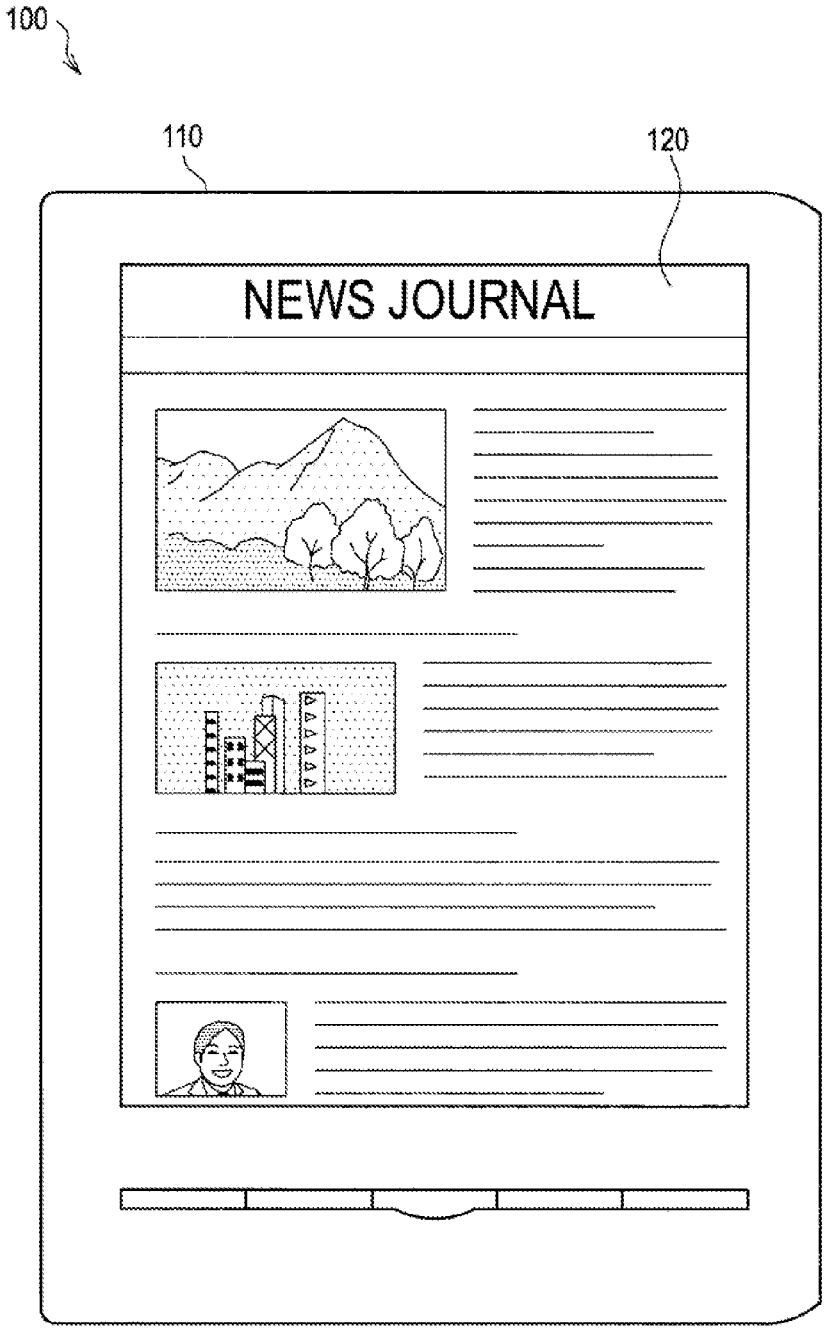
FIG. 1 is an explanatory diagram showing an appearance of a display apparatus according to one embodiment of the present disclosure.

First, an appearance of a display apparatus 100 according to one embodiment of the present disclosure will be explained. FIG. 1 is an explanatory diagram showing the appearance of the display apparatus 100 according to the one embodiment of the present disclosure. As below, the appearance of the display apparatus 100 according to the one embodiment of the present disclosure will be explained using FIG. 1.

As shown in FIG. 1, the display apparatus 100 according to the one embodiment of the present disclosure is the so-called tablet display apparatus, and includes a casing 110 for protection of the display apparatus 100 and a display unit 120 that displays characters, images, and other contents.

The display unit 120 provided in the display apparatus 100 according to the one embodiment of the present disclosure has a configuration in which electronic paper as a reflective sheet-like display device and a transparent display as a display device through which the rear side of the display is seen are closely superimposed.

The transparent display may assume a state in which information is displayed on the display (display-on state) and a state in which the rear side of the display is seen through (display-off state). Further, a display apparatus including a transparent display through which the rear side of the display is seen during display of graphics, characters, etc. on a screen.

In the embodiment, a transparent organic EL display including OLEDs (organic light emitting diodes) inside is used. When the transparent organic EL display is applied, compared to transparent displays of other systems, there are advantages for high image quality display in visual recognition because of good color reproduction and viewing angle and in responsiveness to moving images. Further, when the transparent organic EL display is applied, compared to transparent displays of other systems, a thinner and lighter display apparatus with lower power consumption may be realized. Furthermore, the transparent organic EL display can be partially driven and driven at a lower voltage, and can suppress the power consumption to be lower.

In the embodiment, in the display device 100 having the appearance, information display in which advantages of both display devices of the electronic paper and the transparent display are utilized and the weaknesses of both the display devices are compensated by controlling the information display on the display unit 120 will be explained by taking examples as below.

As above, the appearance of the display apparatus 100 according to the one embodiment of the present disclosure has been explained using FIG. 1. Next, a functional configuration of the display apparatus 100 according to the one embodiment of the present disclosure will be explained.

[1-2. Functional Configuration of Display Apparatus]

Figure 2:
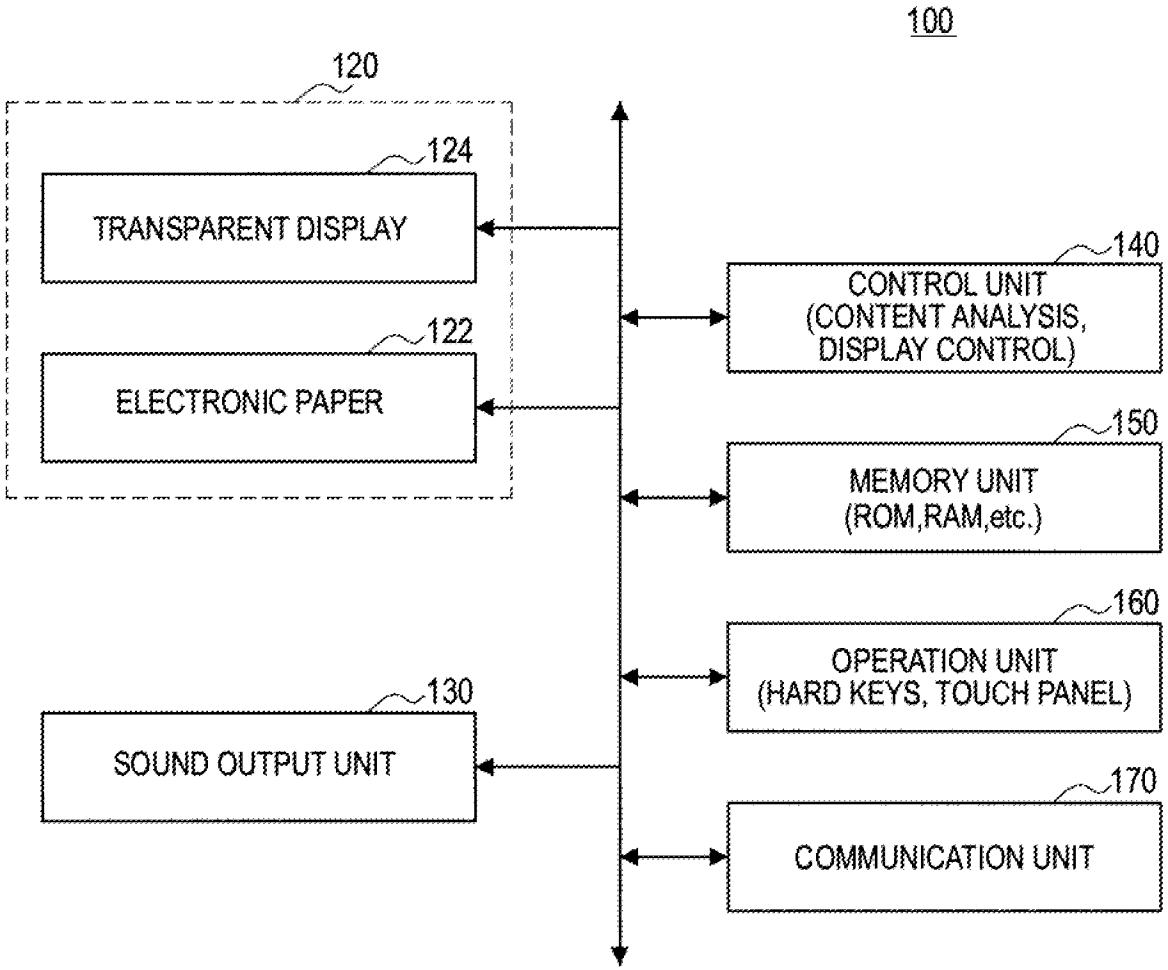
FIG. 2 is an explanatory diagram showing a functional configuration of the display apparatus according to the one embodiment of the present disclosure.

FIG. 2 is an explanatory diagram showing the functional configuration of the display apparatus 100 according to the one embodiment of the present disclosure. As below, the functional configuration of the display apparatus 100 according to the one embodiment of the present disclosure will be explained using FIG. 2.

As shown in FIG. 2, the display apparatus 100 according to the one embodiment of the present disclosure includes the display unit 120 having electronic paper 122 and a transparent display 124, a sound output unit 130, a control unit 140, a memory unit 150, an operation unit 160, and a communication unit 170.

The electronic paper 122 is an example of a first display member according to the present disclosure and a reflective sheet-like display device. The electronic paper 122 may have flexibility. The electronic paper 122 is adapted to display information in response to a signal from the control unit 140.

The transparent display 124 is a display device that may assume the display-on state in which information is displayed on the display and the display-off state in which the rear side of the display is seen through. The transparent display 124 is adapted to see the rear side of the display through an area in which no information is displayed even in the display-on state in which information is displayed on the display.

The display of the electronic paper 122 and the transparent display 124 forming the display unit 120 is controlled by the control unit 140, which will be described later. The display control of the electronic paper 122 and the transparent display 124 by the control unit 140 will be described later.

In the embodiment, the electronic paper 122 and the transparent display 124 are stacked to form the display unit 120. That is, in the embodiment, the transparent display 124 is stacked on the display surface of the electronic paper 122 to form the display unit 120. A user may view the information displayed on the electronic paper 122 even when the transparent display 124 is in the display-off state through the transparent display 124 being transparent in the display-off state. Further, by displaying information in a part of the transparent display 124, the user may view the information displayed on the electronic paper 122 through the transparent area of the transparent display 124 in which no information is displayed.

The electronic paper 122 is a device suitable for display of information with suppressed power consumption because it can hold an image once displayed without energy consumption. However, as described above, there is a problem that the electronic paper 122 has lower rewriting responsiveness and is unsuitable for display of moving images and animations, interactive representation of GUI, or the like.

In the embodiment, the transparent display 124 is superimposed on the display surface of the electronic paper 122, and information requiring high rewriting responsiveness (for example, moving images and GUI) is displayed by the transparent display 124 and information not requiring high rewriting responsiveness (for example, character information) is displayed by the electronic paper 122.

Here, the self-emitting transparent display 124 has a problem of difficulty in representation of black in principle. Therefore, the transparent display 124 alone is difficult to represent black and unsuitable for display of information with high contrast.

Accordingly, in the display apparatus 100 according to the embodiment, as described above, when information requiring high rewriting responsiveness is displayed by the transparent display 124 and information not requiring high rewriting responsiveness is displayed by the electronic paper 122, the area of the electronic paper 122 corresponding to the area for displaying information by the transparent display 124 is displayed in black. Thereby, display of the information with high contrast that is hard to be represented by the transparent display 124 alone may be realized.

Figure 3:
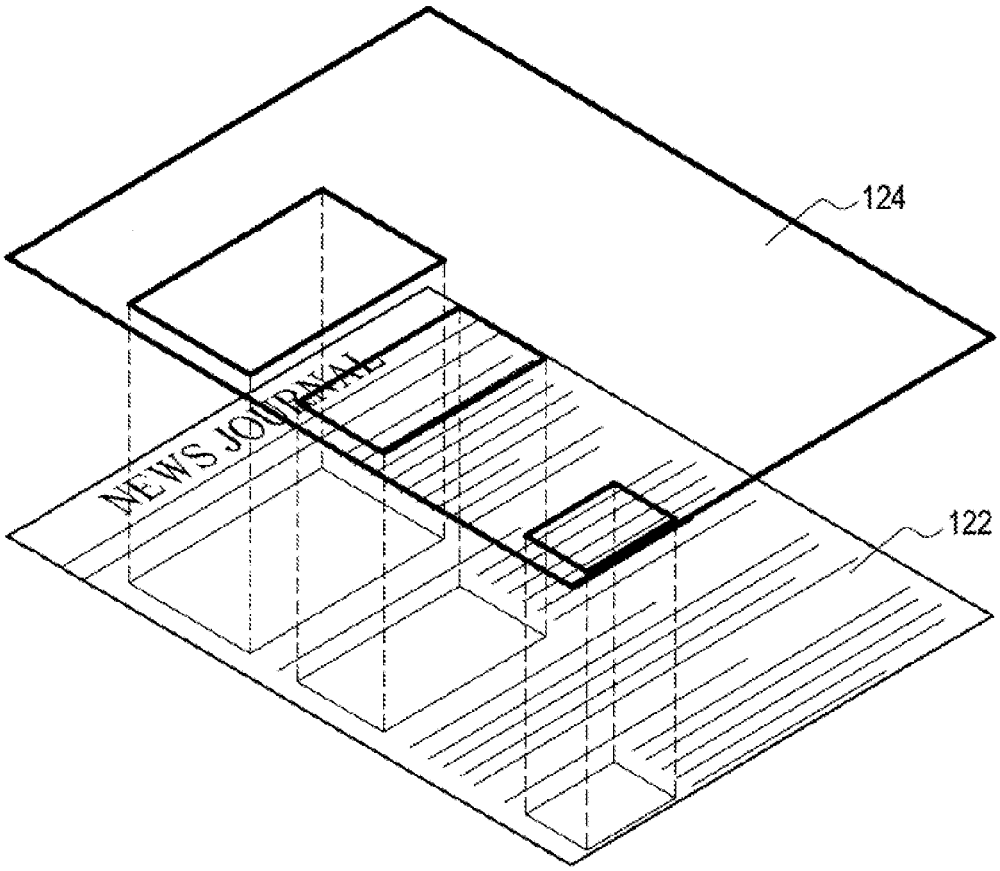
FIG. 3 is an explanatory diagram showing a stacking state of electronic paper and a transparent display in a perspective view.

FIG. 3 is an explanatory diagram showing a stacking state of the electronic paper 122 and the transparent display 124 in a perspective view. In FIG. 3, for convenience of explanation, the electronic paper 122 and the transparent display 124 are separately shown. In the embodiment, as shown in FIG. 3, the electronic paper 122 and the transparent display 124 have the same size, however, in the present disclosure, the electronic paper 122 and the transparent display 124 may have different sizes.

In the embodiment, as shown in FIG. 3, predetermined information is displayed in the area of the transparent display 124 corresponding to the area in which image information is displayed in the electronic paper 122 by the control of the control unit 140. The corresponding area may have areas overlapping with each other when the electronic paper 122 and the transparent display 124 are vertically seen under the condition that the electronic paper 122 and the transparent display 124 are superimposed. The control unit 140 executes the display control on the electronic paper 122 and the transparent display 124, and thereby, the display apparatus 100 according to the embodiment may utilize the advantages of both display devices of the electronic paper 122 and the transparent display 124, compensate for the weaknesses of both the display devices, and display the information.

The sound output unit 130 includes a speaker, a headphone terminal, etc., for example, and is adapted to output sound based on a sound signal. The output of the sound from the sound output unit 130 is controlled by the control unit 140.

The control unit 140 is adapted to control the operation of the display apparatus 100, and includes a CPU (Central Processing Unit) or the like, for example. In the embodiment, the control unit 140 executes control of display of information on the display unit 120, output control of sound from the sound output unit 130, and control in response to input operation by the user using the operation unit 160, for example.

In the embodiment, especially, when predetermined information is displayed on the electronic paper 122 and the transparent display 124, the control unit 140 executes predetermined display control on the electronic paper 122 in the area corresponding to the area in which the transparent display 124 displays information or on the transparent display 124 in the area corresponding to the area in which the electronic paper 122 displays information. The display control on the electronic paper 122 and the transparent display 124 by the control unit 140 will be described in detail later.

The memory unit 150 includes a ROM (Read Only Memory), a RAM (Random Access Memory), an EEPROM (Electrically Erasable Programmable Read-Only Memory), or the like, and stores computer programs used for various control by the control unit 140 and various data generated when the computer programs are executed. The computer programs stored in the memory unit 150 are read out and sequentially executed by the control unit 140.

The operation unit 160 receives operations for the display apparatus 100 by the user of the display apparatus 100. The operation unit 160 includes a hard keyboard, a cursor, a button, etc., for example, and further includes a touch panel. When the touch panel is provided, the touch panel is provided on a surface opposite to the electronic paper 122 side of the transparent display 124. By providing the touch panel in the transparent display 124, the user of the display apparatus 100 may operate the display apparatus 100 by touching the screen.

The communication unit 170 includes a device that executes communication processing between the display apparatus 100 and an apparatus connected through a network. The display apparatus 100 executes communication between the apparatus connected through the network and itself via the communication unit 170, and thereby, may acquire a content from the apparatus, for example, and display the content on the display unit 120.

As above, the functional configuration of the display apparatus 100 according to the one embodiment of the present disclosure has been explained using FIG. 2. Next, an operation of the display apparatus 100 according to the one embodiment of the present disclosure will be explained.

[1-3. Operation of Display Apparatus]

Figure 4:
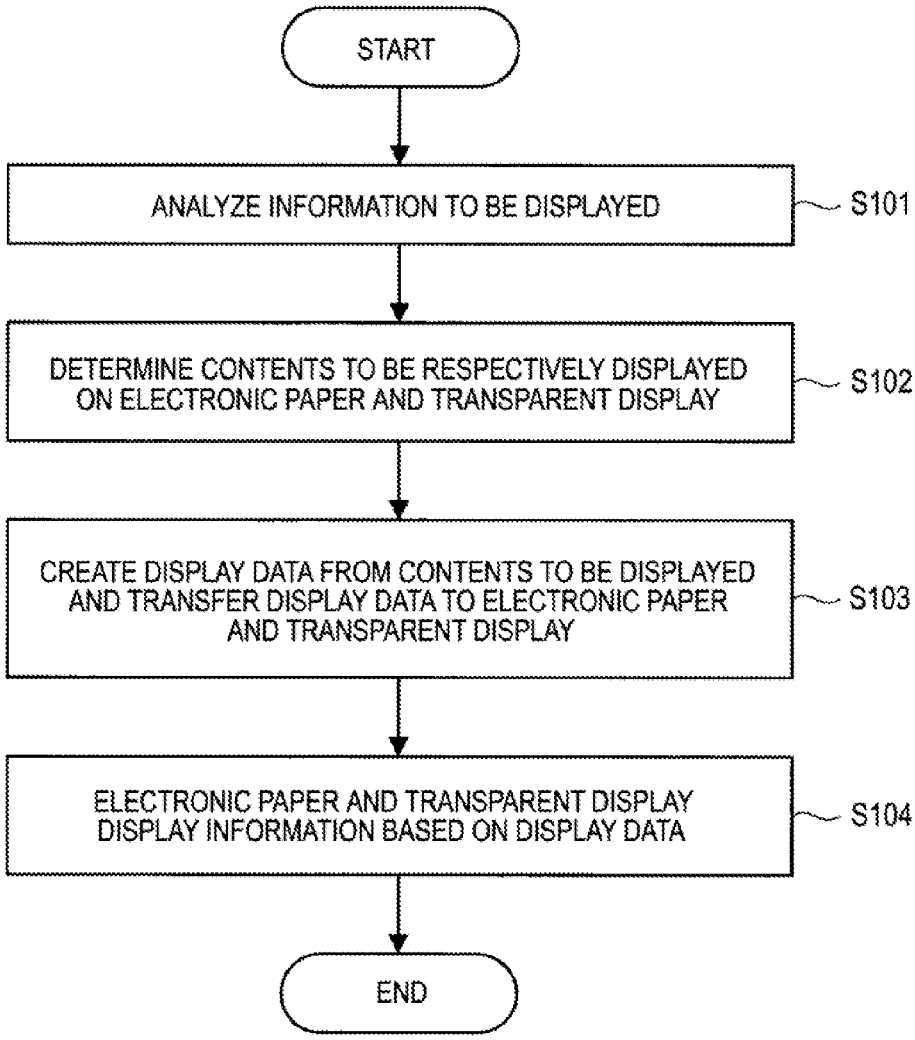
FIG. 4 is a flowchart showing an operation of the display apparatus according to the one embodiment of the present disclosure.

FIG. 4 is a flowchart showing the operation of the display apparatus 100 according to the one embodiment of the present disclosure. The flowchart shown in FIG. 4 shows the operation of the display apparatus 100 when information is displayed on the display unit 120 of the display apparatus 100. As below, the operation of the display apparatus 100 according to the one embodiment of the present disclosure will be explained using FIG. 4.

When information is displayed on the display unit 120, first, the control unit 140 analyzes the information to be displayed on the display unit 120 (step S101). The information analysis by the control unit 140 may be an analysis as to in which area information requiring high rewriting responsiveness such as moving images and GUI is displayed or information not requiring high rewriting responsiveness such as text data is displayed.

For example, if the information to be displayed on the display unit 120 is described in HTML (HyperText Markup Language), the control unit 140 may grasp the position and the kind of information to be displayed in advance before display. Alternately, in the case where an OSK (On Screen Keyboard, a keyboard displayed on the screen) for character entry is displayed on the display unit 120, the control unit 140 may grasp the position in which the OSK should be displayed in advance.

If the control unit 140 has analyzed the information to be displayed on the display unit 120 at the step S101, the control unit 140 determines the contents to be respectively displayed on the electronic paper 122 and the transparent display 124 forming the display unit 120 (step S102). That is, the control unit 140 determines the contents to be respectively displayed on the electronic paper 122 and the transparent display 124 so that information requiring high rewriting responsiveness such as moving images and GUI may be displayed on the transparent display 124 having the higher rewriting responsiveness than that of the electronic paper 122 and other information not requiring high rewriting responsiveness such as text data may be displayed on the electronic paper 122 having the lower rewriting responsiveness than that of the transparent display 124.

If the control unit 140 has determined the contents to be respectively displayed on the electronic paper 122 and the transparent display 124 at the step S102, the control unit 140 creates display data based on the contents to be displayed, and transmits the data to the electronic paper 122 and the transparent display 124 (step S103).

If the control unit 140 has transmitted the display data to the electronic paper 122 and the transparent display 124 at step S103, the electronic paper 122 and the transparent display 124 display information based on the display data transmitted from the control unit 140 (step S104).

In this manner, in the display apparatus 100 according to the one embodiment of the present disclosure, the control unit 140 analyzes the information to be displayed on the display unit 120, determines the contents to be displayed on the electronic paper 122 and the transparent display 124, and creates and transmits the display data. Then, the electronic paper 122 and the transparent display 124 display the information based on the display data transmitted from the control unit 140.

In the display apparatus 100 according to the one embodiment of the present disclosure, by controlling the display for the display unit 120 in this manner, display of information utilizing the respective advantages of the electronic paper 122 and the transparent display 124 forming the display unit 120 and compensating the weaknesses may be realized.

As above, the operation of the display apparatus 100 according to the one embodiment of the present disclosure has been explained using FIG. 4. Subsequently, the specific display control on the electronic paper 122 and the transparent display 124 by the control unit 140 will be explained by taking some examples.

Figure 5:
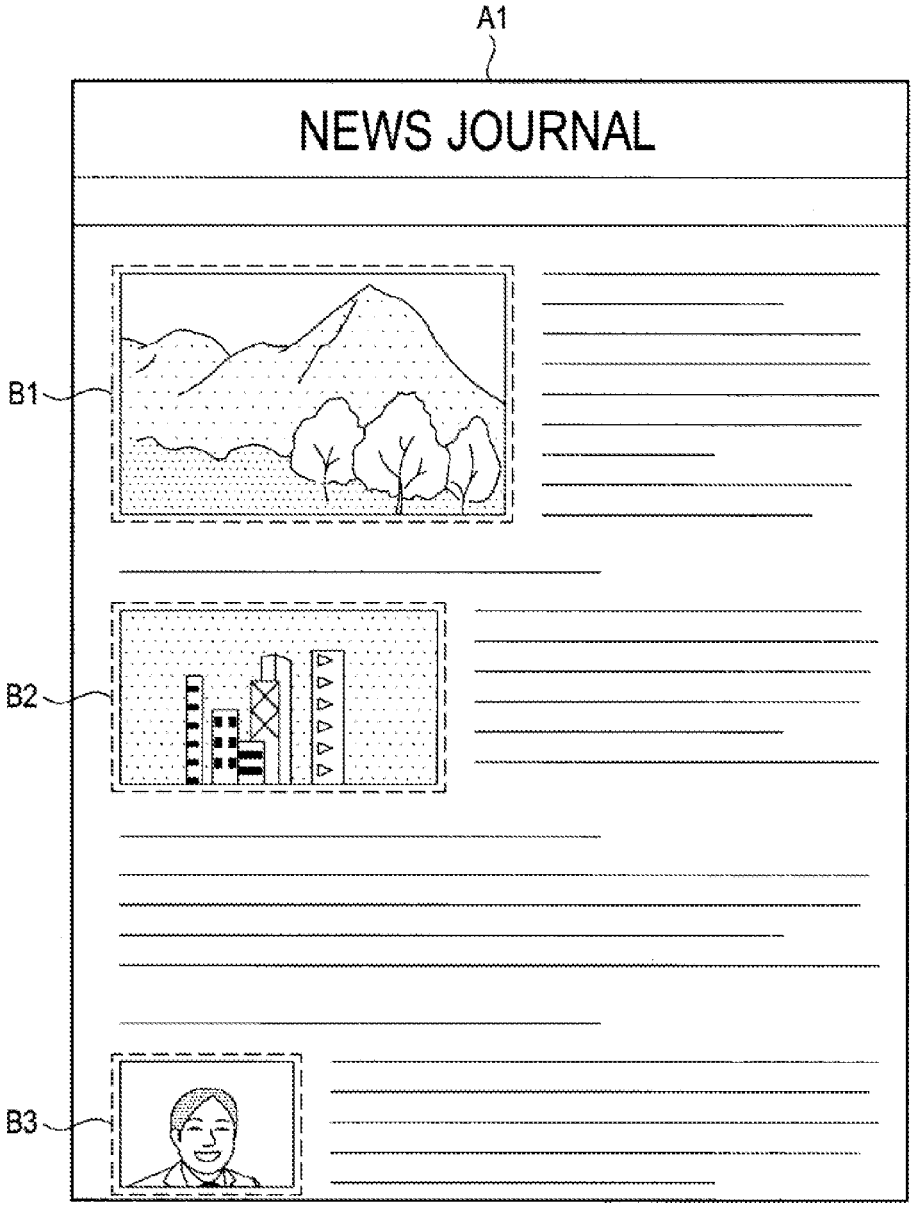
FIG. 5 is an explanatory diagram showing an example of information to be displayed on a display unit.

FIG. 5 is an explanatory diagram showing an example of information to be displayed on the display unit 120. FIG. 5 shows information A1 as the information to be displayed on the display unit 120. The information A1 includes areas B1, B2, B3 in which moving images are displayed. Note that the broken lines surrounding the areas B1, B2, B3 are drawn for convenience of explanation, and these broken lines are not displayed in the information A1.

For the display of the moving images to be displayed in the areas B1, B2, B3, the high rewriting responsiveness is required. Therefore, the control unit 140 assigns display so that the information to be displayed in the areas B1, B2, B3 may be displayed on the transparent display 124 and other information may be displayed on the electronic paper 122.

Figure 6A:
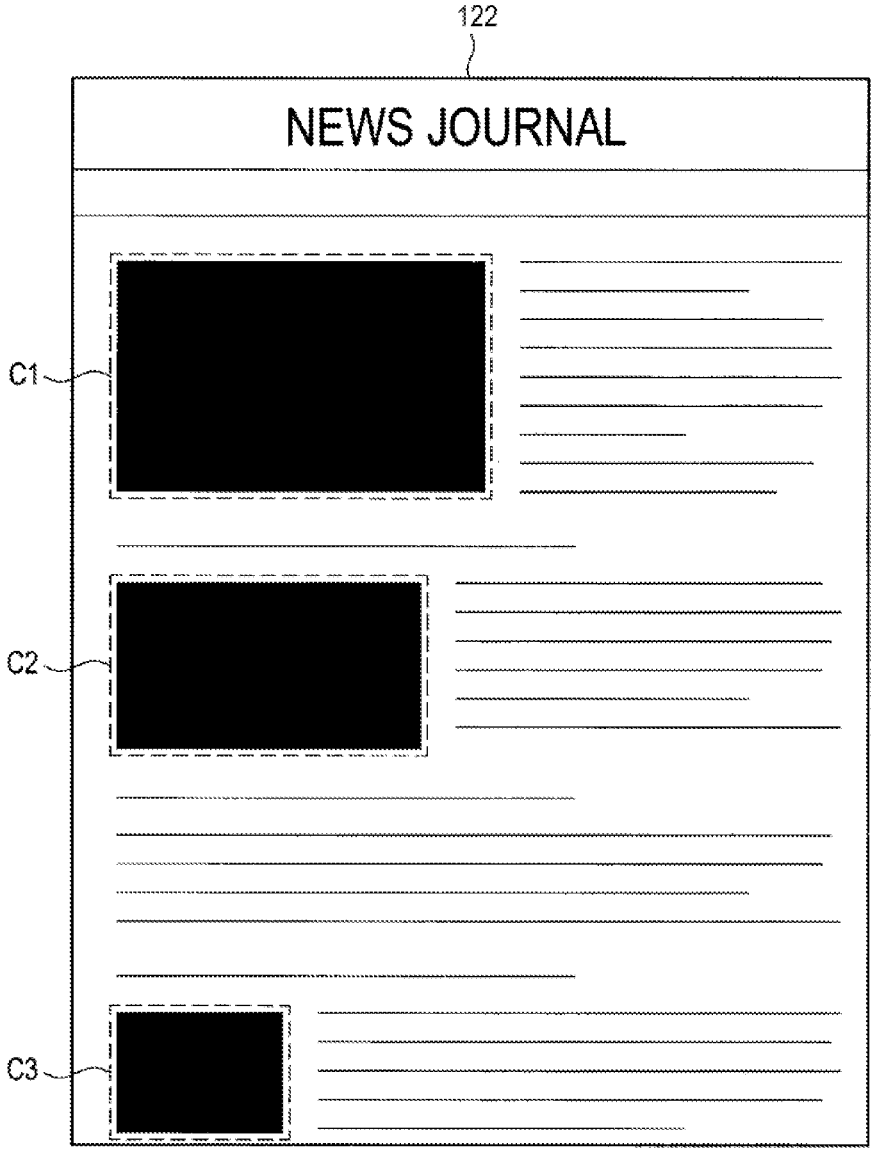
FIG. 6A is an explanatory diagram showing a display example when information A1 shown in FIG. 5 is displayed on the electronic paper.
Figure 6B:
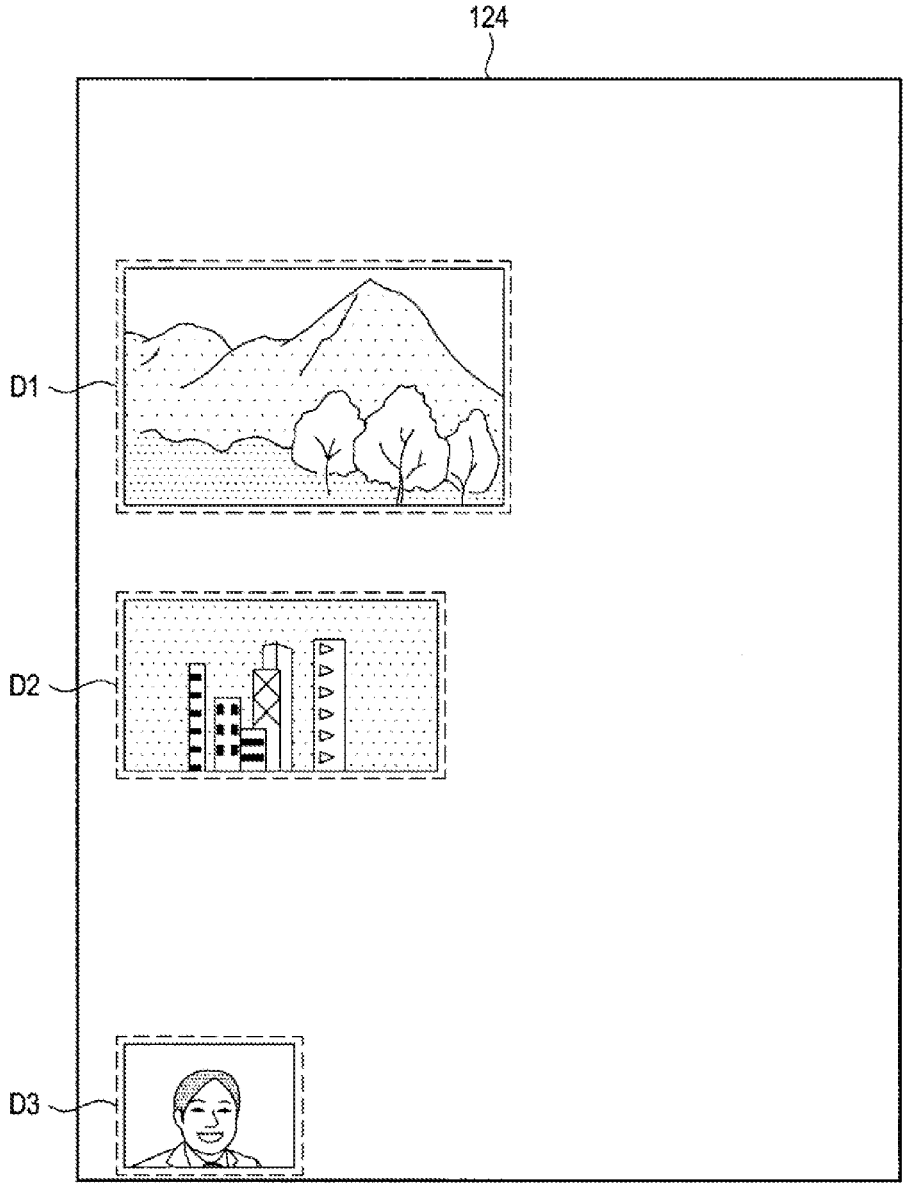
FIG. 6B is an explanatory diagram showing a display example when the information A1 shown in FIG. 5 is displayed on the transparent display.

FIGS. 6A and 6B are explanatory diagrams showing display examples when the information A1 shown in FIG. 5 is displayed on the electronic paper 122 and the transparent display 124. FIGS. 6A and 6B show the display examples of the electronic paper 122 and the transparent display 124, display of which is controlled by the control unit 140.

FIG. 6A shows the display example of the electronic paper 122 controlled to display only character information by the control unit 140. Further, as shown in FIG. 6A, areas C1, C2, C3 respectively corresponding to the areas B1, B2, B3 in FIG. 5 are controlled to display in black or dark color by the control unit 140. This will be a back ground when the moving images to be displayed in the areas B1, B2, B3 in FIG. 5 are displayed by the transparent display 124.

FIG. 6B shows the display example of the transparent display 124 controlled to display only moving images to be displayed in the areas B1, B2, B3 by the control unit 140. As shown in FIG. 6B, the transparent display 124 is controlled to respectively display the moving images to be displayed in the areas B1, B2, B3 in areas D1, D2, D3 respectively corresponding to the areas B1, B2, B3 in FIG. 5 by the control unit 140.

When the moving images are displayed in the areas D1, D2, D3 of the transparent display 124, the areas C1, C2, C3 of the electronic paper 122 are displayed in black, and thus, higher contrast images may be displayed than those in the case where the moving images are simply displayed on the transparent display 124.

In this manner, the control unit 140 performs control so that the moving images to be displayed in the areas B1, B2, B3 requiring high rewriting responsiveness of the information A1 shown in FIG. 5 may be displayed on the transparent display 124 having the higher rewriting responsiveness than that of the electronic paper 122 and other information may be displayed on the electronic paper 122 having the lower rewriting responsiveness than that of the transparent display 124. The display apparatus 100 assigns display to the electronic paper 122 and the transparent display 124 as described above, and thereby, may perform display utilizing the respective advantages and compensating the disadvantages of the displays.

Figure 7:
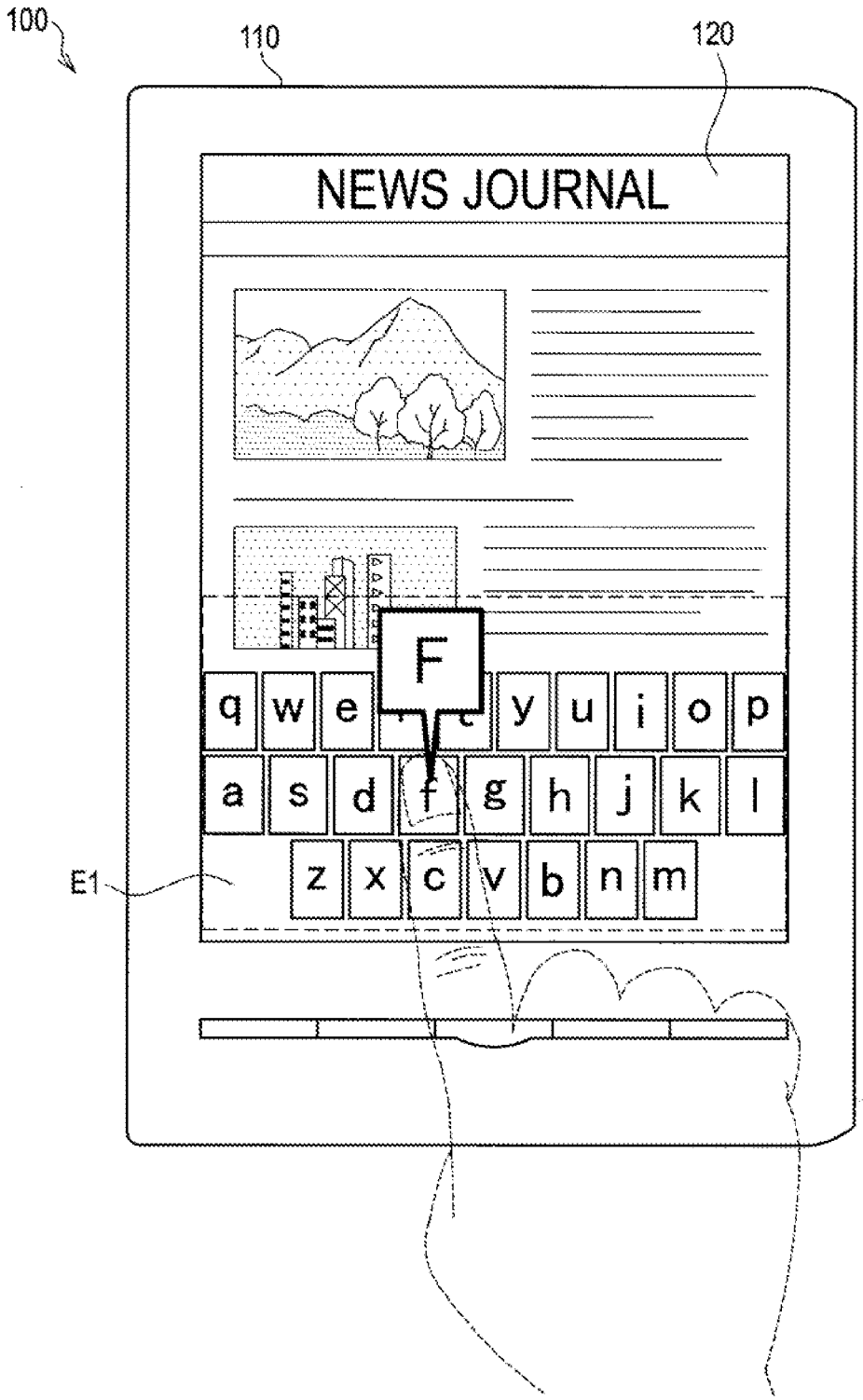
FIG. 7 is an explanatory diagram showing the display apparatus according to the one embodiment of the present disclosure and an example of a screen displayed on the display unit of the display apparatus.

Another example of the display control for the electronic paper 122 and the transparent display 124 by the control unit 140 will be illustrated. FIG. 7 is an explanatory diagram showing the display apparatus 100 according to the one embodiment of the present disclosure and an example of a screen displayed on the display unit 120 of the display apparatus 100.

FIG. 7 shows a condition that an area E1 for displaying an on-screen keyboard is displayed on the display unit 120 of the display apparatus 100. The on-screen keyboard is a user interface that enables the user of the display apparatus 100 to perform character entry by the user of the display apparatus 100 touching the display unit 120 using a hand H. Note that the broken line surrounding the area E1 in FIG. 7 is drawn for convenience of explanation, and the broken line is not displayed in the display unit 120.

The on-screen keyboard displayed in the area E1 has a function, when the user touches the on-screen keyboard, of enlarging the character touched by the user for easy recognition of the touched character. The enlarged display is continuously performed while the user touches the on-screen keyboard, and erased from the screen when the user takes his or her finger from the on-screen keyboard.

Therefore, the on-screen keyboard displayed in the area E1 is also regarded as information requiring high rewriting responsiveness. Accordingly, the on-screen keyboard is displayed on the transparent display 124, and thereby, the display apparatus 100 may display information with low power consumption without losing the operability of the on-screen keyboard.

Figure 8:
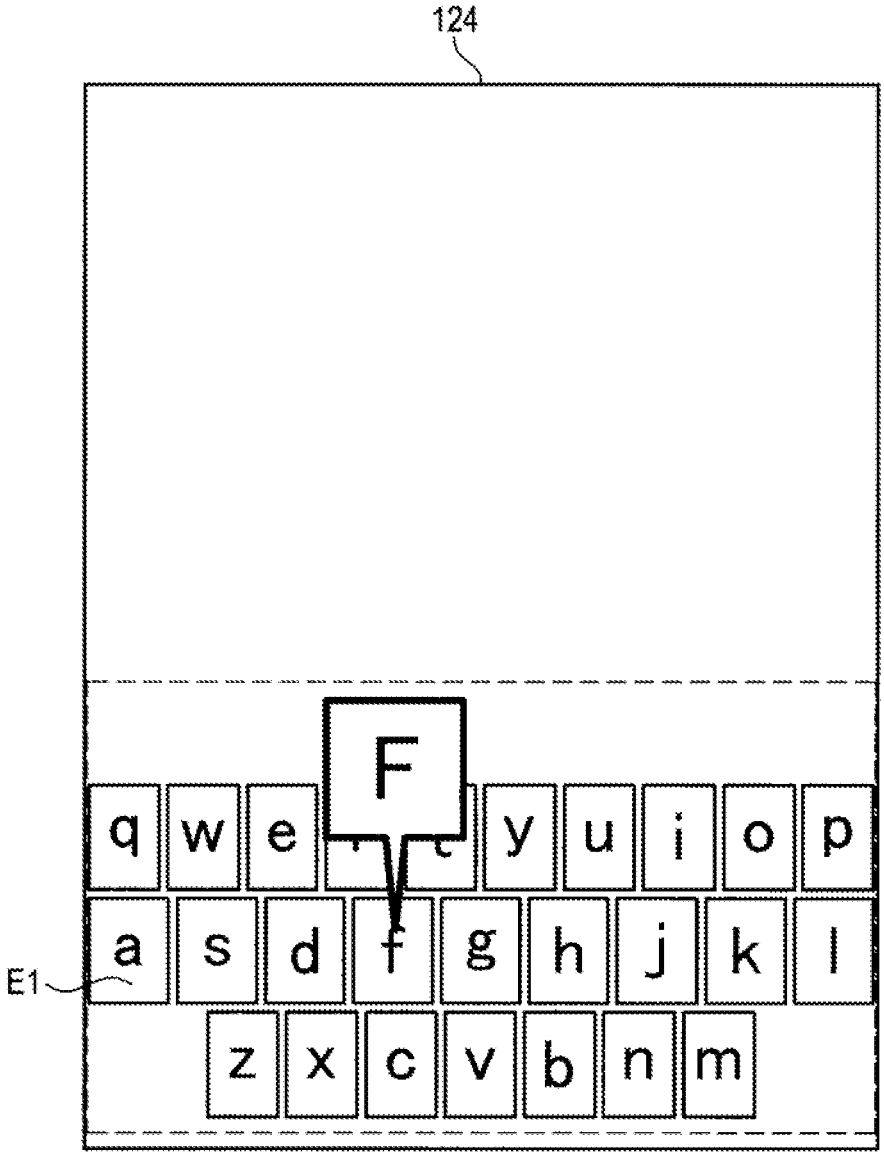
FIG. 8 is an explanatory diagram showing a display example of the transparent display.

FIG. 8 is an explanatory diagram showing a display example of the transparent display 124. FIG. 8 shows a condition in which only the on-screen keyboard displayed in the area E1 shown in FIG. 7 is displayed on the transparent display 124 under the control of the control unit 140.

Under the display control of the control unit 140, the display apparatus 100 may realize display of information with low power consumption without losing the operability of the on-screen keyboard by displaying the on-screen keyboard requiring high rewriting responsiveness on the transparent display 124 while displaying information on the electronic paper 122.

In the case where the on-screen keyboard is displayed on the transparent display 124 as shown in FIG. 8, the area corresponding to the area E1 of the electronic paper 122 on the back of the transparent display 124 may be displayed in black or dark color as shown in FIG. 6A.

Another example of the display control for the electronic paper 122 and the transparent display 124 by the control unit 140 will be illustrated. The electronic paper 122 and the transparent display 124 may display different information in the corresponding identical areas under the control of the control unit 140, or may display the same information in the corresponding identical areas.

In the case where the same information is displayed in the corresponding identical areas respectively on the electronic paper 122 and the transparent display 124 under the control of the control unit 140, the control unit 140 may control the display of the transparent display 124 on the assumption that information is displayed on the electronic paper 122. The display control of the transparent display 124 on the assumption that information is displayed on the electronic paper 122 includes brightness control and color control of the transparent display 124, for example.

Figure 9A:
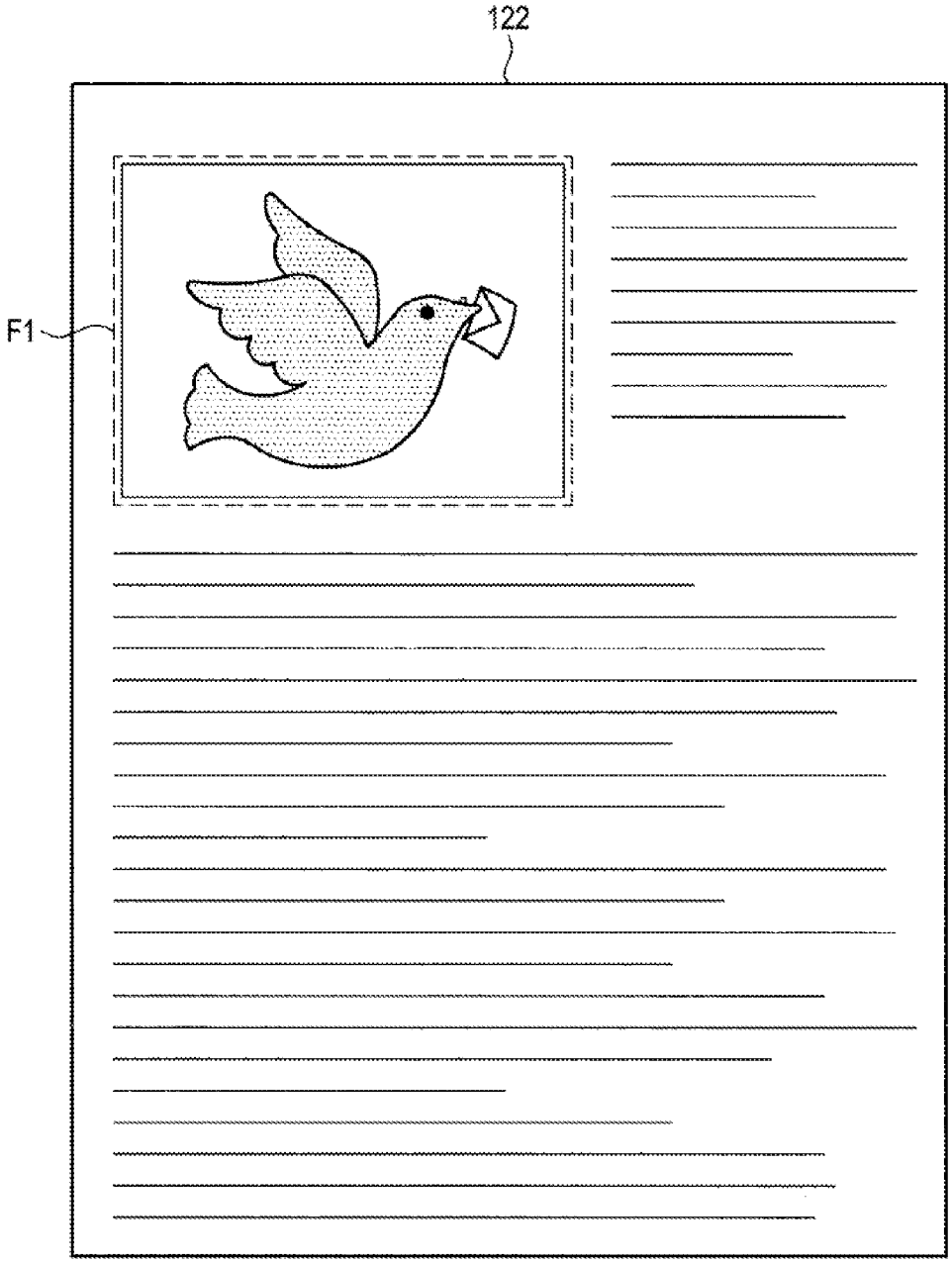
FIG. 9A is an explanatory diagram showing a display example of the electronic paper.
Figure 9B:
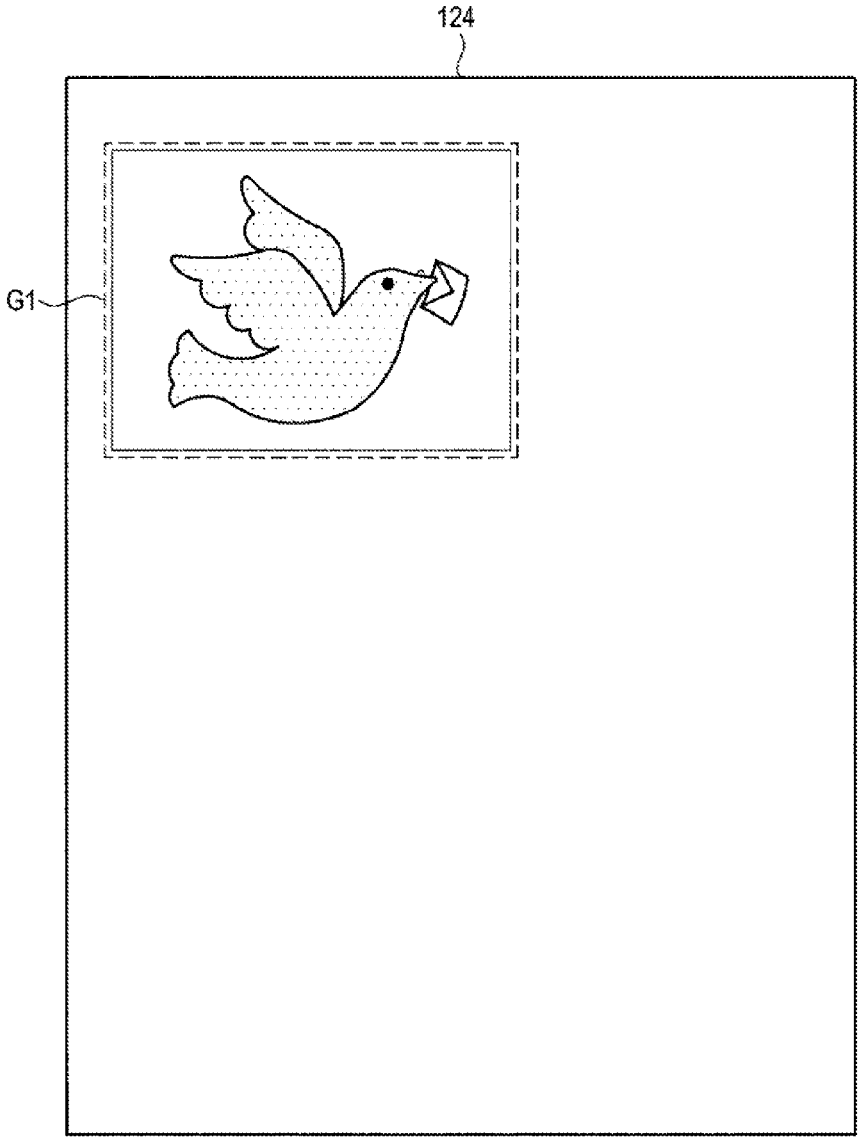
FIG. 9B is an explanatory diagram showing a display example of the transparent display.

FIGS. 9A and 9B are explanatory diagrams showing display examples of the electronic paper 122 and the transparent display 124 controlled by the control unit 140. FIG. 9A shows the display example of the electronic paper 122 controlled by the control unit 140 and shows a condition in which character information and image information are displayed. FIG. 9B shows the display example of the transparent display 124 controlled by the control unit 140 and shows a condition in which only image information is displayed. The electronic paper 122 displays image information in an area F1 of FIG. 9A under the control of the control unit 140, and FIG. 9B displays image information in an area G1 of FIG. 9A under the control of the control unit 140.

In this manner, when the information is displayed on the electronic paper 122 and the transparent display 124 under the control of the control unit 140, the control unit 140 executes display control (brightness control and color control) of the transparent display 124 in consideration of the information displayed on the electronic paper 122. Thereby, the user of the display apparatus 100 may view the information without a feeling of strangeness when viewing the display unit 120. Further, the electronic paper 122 has the lower rewriting responsiveness than that of the transparent display 124, and thus, by leaving the image displayed in the area F1 of the electronic paper 122, the control unit 140 turns off the display of the transparent display 124 at the time when reproduction of moving images is finished, and thereby, the display condition of the display unit 120 may be promptly returned to the original condition before reproduction of moving images.

The display control of the transparent display 124 in consideration of the information displayed on the electronic paper 122 is not limited to the case where the electronic paper 122 and the transparent display 124 display images based on the same information. For example, among the contents displayed by the display unit 120 in the display apparatus 100, there is a content that is first displayed as still images (or images simply indicating play buttons for reproducing moving images) and, when the user selects the still image by touching or otherwise, a moving image corresponding to the still image is reproduced.

Figure 10A:
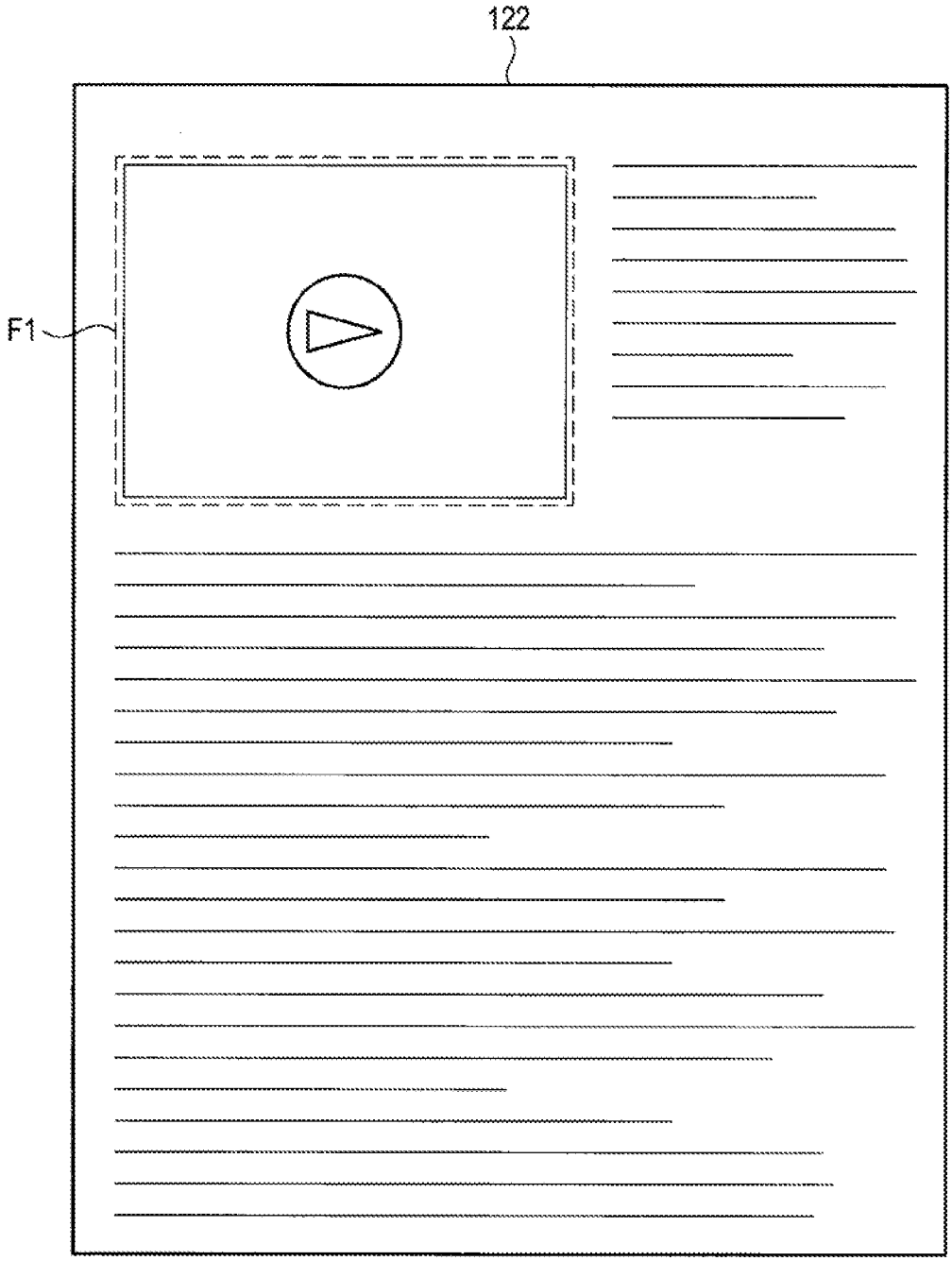
FIG. 10A is an explanatory diagram showing a display example of the electronic paper.
Figure 10B:
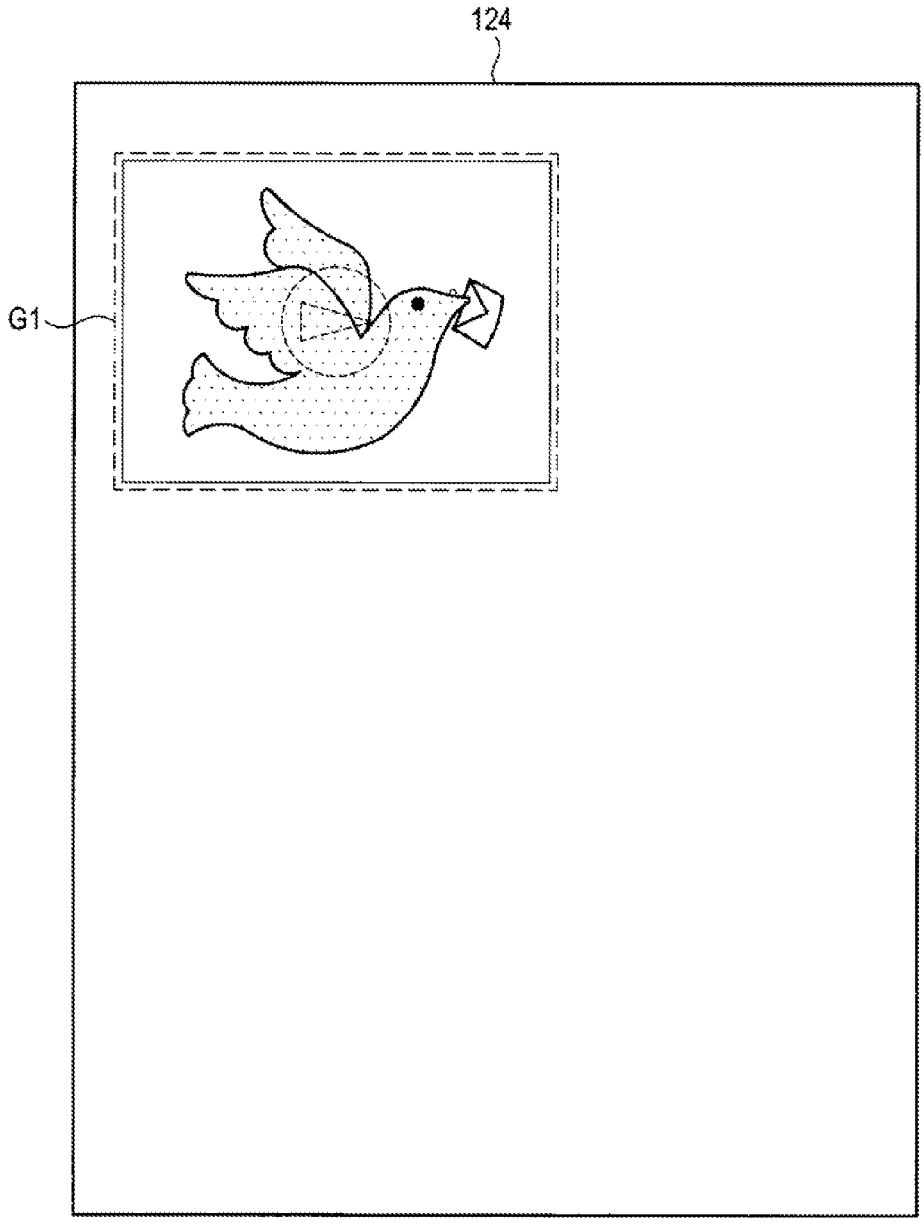
FIG. 10B is an explanatory diagram showing a display example of the transparent display.

FIGS. 10A and 10B are explanatory diagrams showing display examples of the electronic paper 122 and the transparent display 124, display of which is controlled by the control unit 140. FIG. 10A shows the display example of the electronic paper 122 controlled by the control unit 140 and shows a condition in which character information and image information are displayed. FIG. 10B shows the display example of the transparent display 124 controlled by the control unit 140 and shows a condition in which only image information is displayed.

In an area F1 of FIG. 10A, a play mark indicating that a moving image may be reproduced is displayed. Therefore, when the user touches the area (actually, the user touches an area G1 on the transparent display 124 superimposed on the electronic paper 122), the control unit 140 detects the contact by the user and controls the display to reproduce the moving image on the transparent display 124.

Further, the control unit 140 performs display control on the assumption that the play mark is displayed in the area F1 of the electronic paper 122 as display control for the transparent display 124. The electronic paper 122 has the lower rewriting responsiveness, and thus, by leaving the play mark displayed in the area F1 of the electronic paper 122, the control unit 140 turns off the display of the transparent display 124 at the time when reproduction of moving images is finished, and thereby, the display condition of the display unit 120 may be promptly returned to the original condition before reproduction of moving images.

When the display of the transparent display 124 is turned off and display is switched to the electronic paper 122, there is a problem that it takes time to display a desired image on the electronic paper 122 because the electronic paper 122 has the lower rewriting responsiveness. This problem may apply stress of keeping the user to wait for the display.

Accordingly, the control unit 140 may perform display control on the transparent display 124 to take time to reduce brightness to predetermined target brightness by a predetermined time. Thereby, when the display of the display unit 120 is switched from the transparent display 124 to the electronic paper 122, display that does not make the user to feel waiting may be realized.

Figure 11:
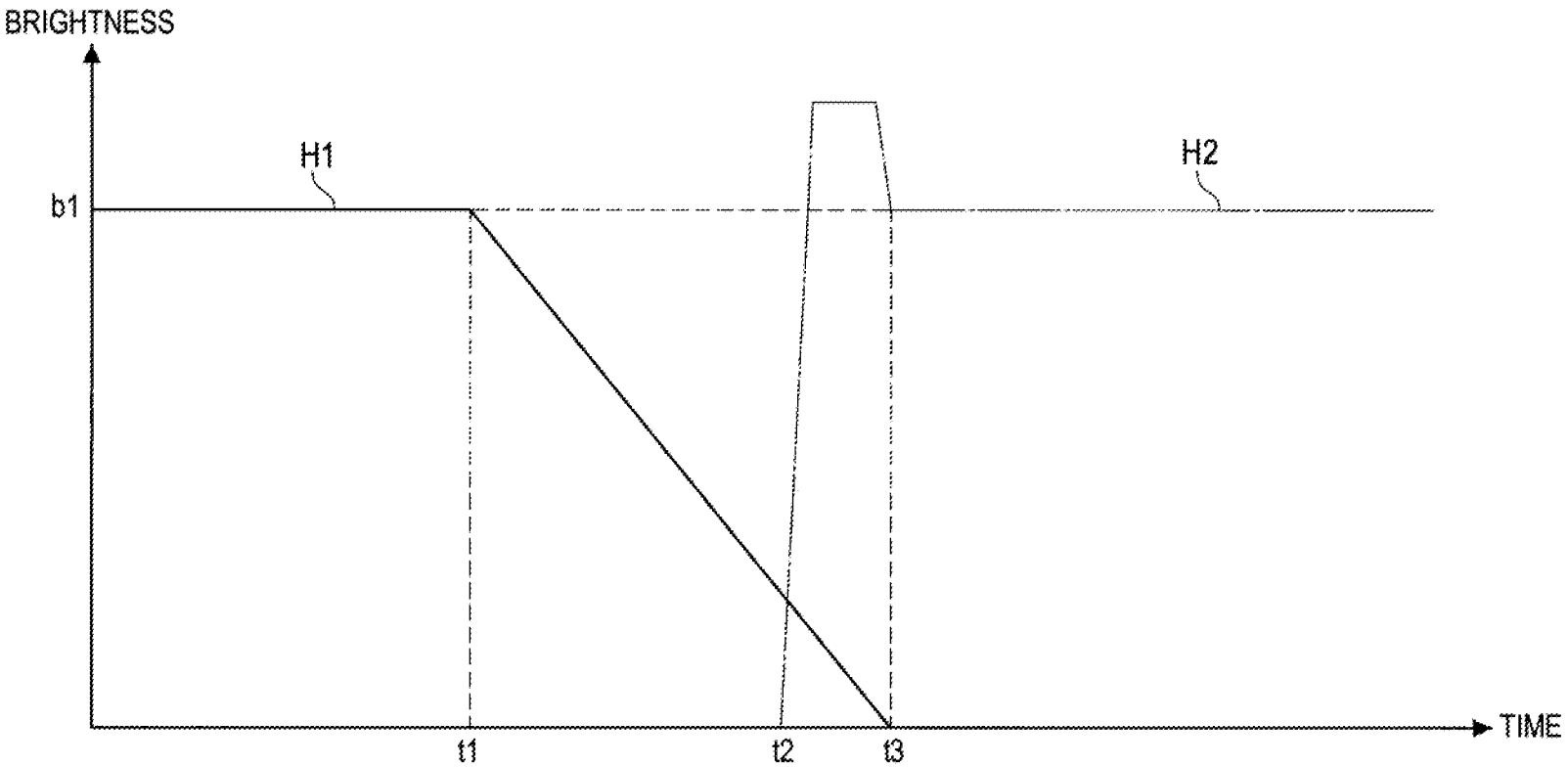
FIG. 11 is an explanatory diagram showing an example of brightness control of the electronic paper and the transparent display.

FIG. 11 is an explanatory diagram showing an example of brightness control of the electronic paper 122 and the transparent display 124 in graphic representation. In the graph shown in FIG. 11, the vertical axis indicates brightness and the horizontal axis indicates time. Further, the line shown by sign H1 shows an example of brightness change of the transparent display 124, and the line shown by sign H2 shows an example of brightness change of the electronic paper 122.

At time t1, display by the transparent display 124 is finished. Here, according to the property of the transparent display 124, the brightness may be promptly minimized from b1. However, here, the brightness of the transparent display 124 is gradually reduced from b1 under the control of the control unit 140.

Then, at time t2 after time t1, rewriting processing of the electronic paper 122 is started. The electronic paper 122 performs rewriting of information by once maximizing the brightness and reducing it to desired brightness.

Then, at time t3 after time t2, the brightness of the electronic paper 122 reaches the desired brightness and the brightness of the transparent display 124 becomes the minimum. The control unit 140 may control the brightness of the transparent display 124 in this manner. The control unit 140 controls the brightness of the transparent display 124 as shown in FIG. 11, and thereby, when the display of the display unit 120 is switched from the transparent display 124 to the electronic paper 122, display may be switched without a feeling of strangeness.

Obviously, the brightness control of the transparent display 124 by the control unit 140 is not limited to the example. In the example in FIG. 11, the control unit 140 may control the brightness of the transparent display 124 to be the minimum at the time before time t3.

The specific display control for the electronic paper 122 and the transparent display 124 by the control unit 140 have been explained by taking some examples. Obviously, the display control for the electronic paper 122 and the transparent display 124 by the control unit 140 is not limited to the examples. Regardless to say, in response to the contents to be displayed in the display unit 120, the control unit 140 may perform appropriate display control for the electronic paper 122 and the transparent display 124 within the scope of the present disclosure.

For example, for animating processing at switching of pages, the control unit 140 may perform appropriate display control for the electronic paper 122 and the transparent display 124. The display of switching pages is not suitable for electronic paper. Therefore, the control unit 140 once switches the entire display to the transparent display 124 and allows the transparent display 124 to display the animation of the page switching. During switching of pages, the control unit 140 controls the electronic paper 122 to display the switched page. If display of a new page is prepared by the electronic paper 122, the control unit 140 switches display of information from the transparent display 124 to the electronic paper 122.

The control unit 140 performs the display control, and thereby, the display apparatus 100 can perform animation display of page switching in the display unit 120 and can display information with suppressed power consumption after page switching by changing to the display by the electronic paper 122.

Further, for example, in an area in which no information is displayed on the transparent display 124, the control unit 140 may perform control of display with reduced brightness of the entire area. In the area in which no information is displayed on the transparent display 124, the control of display with reduced brightness of the entire area may be control of reducing the brightness itself, control of reducing brightness per unit time by temporally changing the brightness, or control of reducing the brightness in a part of the area, for example. The control of reducing the brightness in a part of the area may be control of reducing the brightness of dots in a part of the area or control of reducing the brightness of the entire lines in a part of the area, for example. The control unit 140 performs control in the area in which no information is displayed on the transparent display 124 of reducing the brightness of the entire area, and thereby, the display apparatus 100 according to the embodiment may obtain an advantage that visual recognition of the electronic paper 122 is improved.

<2. Conclusion>

As explained above, the display apparatus 100 according to the one embodiment of the present disclosure has the configuration in which the electronic paper 122 as the reflective sheet-like display device and the transparent display 124 as the display device through which the rear side of the display is seen are superimposed as the display unit 120 for displaying information.

Further, the control unit 140 performs predetermined display control on the electronic paper 122 and the transparent display 124. The predetermined display control is control of respectively displaying the information not requiring high rewriting responsiveness such as character information and still images on the electronic paper 122 having the lower rewriting responsiveness than that of the transparent display 124 and the information requiring high rewriting responsiveness such as moving images and GUI like OSK on the transparent display 124 having the remarkably higher rewriting responsiveness than that of the electronic paper 122. In this manner, by assigning display of information to the electronic paper 122 and the transparent display 124, the display apparatus 100 according to the one embodiment of the present disclosure may perform information display, which has been difficult only by the electronic paper 122, while suppressing the power consumption for information display compared to the case where all information is displayed by the transparent display 124.

When the information requiring high rewriting responsiveness such as moving images and GUI like OSK on the transparent display 124, the control unit 140 controls the display of the electronic paper 122 in black or dark color in the area of the electronic paper 122 corresponding to the area in which the information is displayed. The control unit 140 performs the display control in this manner, and thereby, the display apparatus 100 according to the one embodiment of the present disclosure may compensate the weakness of the transparent display 124 having difficulty in black display because of its property, and may display information with high contrast as the entire display unit 120.

Further, when the electronic paper 122 and the transparent display 124 display the same or different information in the corresponding identical areas, the control unit 140 executes display control (brightness control and color control) on the transparent display 124 on the assumption that the information is displayed on the electronic paper 122. The control unit 140 performs the display control in this manner, and thereby, the display apparatus 100 according to the one embodiment of the present disclosure may display information without a feeling of strangeness for the user.

The embodiment has been explained by taking the tablet display apparatus 100 as an example, however, the apparatus to which the technology of the present disclosure is applied is not limited to that. For example, the technology of the present disclosure may be similarly applied to cellular phones, PDAs (Personal Digital Assistants), game machines, electronic dictionaries, and other display apparatuses.

Further, the steps shown in the flowchart of the embodiment include the time-series processing in the described order as well as not time-series processing, but executed in parallel or individually. It is obvious that even the time-series processed steps may be appropriately changed in order according to need.

In addition, the series of processing explained in the specification may be executed by hardware, software, or a compound configuration of hardware and software. When processing by software is executed, a program in which a processing sequence is recorded may be installed in a memory of a computer incorporated in dedicated hardware and executed, or the program may be installed in a general-purpose computer that can execute various processing and executed.

The preferred embodiment of the present disclosure has been explained in detail with reference to the accompanying drawings, however, the present disclosure is not limited to the example. It is clear that a person ordinarily skilled in the art of the present disclosure could reach various modified examples or altered examples within the scope of the technical idea described in the appended claims, and it would be naturally understood that the examples fall within the technical scope of the present disclosure.

Note that the technology of the present disclosure may employ the following configuration.

(1) A display control device includes a display control unit that controls display of a reflective first display member and a self-emitting second display member that is provided in superimposition on a display surface of the first display member, has higher rewriting responsiveness than that of the first display member, and may transmit display of the first display member, wherein, when predetermined information is displayed on the first display member and the second display member, the display control unit performs predetermined display control on the first display member in an area corresponding to an area in which the second display member displays information and on the second display member in an area corresponding to an area in which the first display member displays information.

(2) The display control device according to (1), wherein the display control unit performs control of allowing the first display member to display in a state lower than a predetermined reflection state in the area corresponding to the area in which the second display member displays information as the predetermined display control for the first display member.

(3) The display control device according to (1) or (2), wherein the display control unit performs display control based on the information displayed in the first member in the area corresponding to the area in which the second display member displays information as the predetermined display control for the second display member.

(4) The display control device according to (3), wherein the display control unit performs display control on the second display member based on a fact that the same information is displayed in the area in which the second display member displays information and the area in which the first member displays information corresponding to that area.

(5) The display control device according to (3), wherein the display control unit performs display control on the second display member based on a fact that different information is displayed in the area in which the second display member displays information and the area in which the first member displays information corresponding to that area.

(6) The display control device according to any one of (1) to (5), wherein the display control unit performs control of displaying with reduced brightness of an entire area corresponding to an area in which no information is displayed in the second member as the predetermined display control for the second display member.

(7) The display control device according to any one of (1) to (6), wherein the display control unit performs brightness control of reducing brightness in response to a time when rewriting of information of the first member is completed when information is displayed in the first member as the predetermined display control for the second display member.

(8) The display control device according to any one of (1) to (7), wherein the corresponding area has an area in which the first display member and the second display member overlap each other as vertically seen under a condition in which the first display member and the second display member are superimposed.

(9) The display control device according to any one of (1) to (8), wherein the first display member and the second display member have the same size.

(10) A display control method includes a display control step of controlling display of a reflective first display member and a self-emitting second display member that is provided in superimposition on a display surface of the first display member, has higher rewriting responsiveness than that of the first display member, and may transmit display of the first display member, wherein, when predetermined information is displayed on the second display member, the display control step performs predetermined display control on the first display member in an area corresponding to an area in which the second display member displays information.

(11) A computer program allows a computer to execute a display control step, in a display apparatus including a reflective first display member and a self-emitting second display member that is provided in superimposition on a display surface of the first display member, has higher rewriting responsiveness than that of the first display member, and may transmit display of the first display member, when predetermined information is displayed on the second member, of performing predetermined display control on the first display member in an area corresponding to an area in which the second display member displays information.

It should be understood by those skilled in the art that various modifications, combinations, sub-combinations and alterations may occur depending on design requirements and other factors insofar as they are within the scope of the appended claims or the equivalents thereof.

What is claimed is:

1. A display control device comprising:

a display control unit that controls display of a reflective first display member and a self-emitting second display member that is provided in superimposition on a display surface of the first display member, said second display member having higher rewriting responsiveness than that of the first display member, and being operable to transmit display of the first display member, wherein, when predetermined information is displayed on the first display member and the second display member, the display control unit performs predetermined display control on the first display member in an area corresponding to an area in which the second display member displays information or on the second display member in an area corresponding to an area in which the first display member displays information, and wherein, when information which involves high rewriting responsiveness is displayed on the second display member and information which does not involve the high rewriting responsiveness is displayed on the first display member, the display control unit performs predetermined display control so that the area of the first display member corresponding to the area in which the second display member displays the high rewriting responsiveness information is displayed in black.

2. The display control device according to claim 1, wherein the display control unit performs control of allowing the first display member to display in a state lower than a predetermined reflection state in the area corresponding to the area in which the second display member displays information as the predetermined display control for the first display member.

3. The display control device according to claim 1, wherein the display control unit performs display control based on the information displayed in the first member in the area corresponding to the area in which the second display member displays information as the predetermined display control for the second display member.

4. The display control device according to claim 3, wherein the display control unit performs display control on the second display member based on a fact that the same information is displayed in the area in which the second display member displays information and the area in which the first member displays information corresponding to that area.

5. The display control device according to claim 3, wherein the display control unit performs display control on the second display member based on a fact that different information is displayed in the area in which the second display member displays information and the area in which the first member displays information corresponding to that area.

6. The display control device according to claim 1, wherein the display control unit performs control of displaying with reduced brightness of an entire area corresponding to an area in which no information is displayed in the second member as the predetermined display control for the second display member.

7. The display control device according to claim 1, wherein the display control unit performs brightness control of reducing brightness in response to a time when rewriting of information of the first member is completed when information is displayed in the first member as the predetermined display control for the second display member.

8. The display control device according to claim 1, wherein the corresponding area has an area in which the first display member and the second display member overlap each other as vertically seen under a condition in which the first display member and the second display member are superimposed.

9. The display control device according to claim 1, wherein the first display member and the second display member have the same size.

10. A display control method comprising:

controlling display of a reflective first display member and a self-emitting second display member that is provided in superimposition on a display surface of the first display member, said second display member having higher rewriting responsiveness than that of the first display member, and being operable to transmit display of the first display member, wherein, when predetermined information is displayed on the second display member, the controlling performs predetermined display control on the first display member in an area corresponding to an area in which the second display member displays information, and wherein, when information which involves high rewriting responsiveness is displayed on the second display member and information which does not involve the high rewriting responsiveness is displayed on the first display member, the controlling performs predetermined display control so that the area of the first display member corresponding to the area in which the second display member displays the high rewriting responsiveness information is displayed in black.

11. A computer program allowing a computer to execute display control, in a display apparatus including a reflective first display member and a self-emitting second display member that is provided in superimposition on a display surface of the first display member, said second display member having higher rewriting responsiveness than that of the first display member, and being operable to transmit display of the first display member, when predetermined information is displayed on the second member, of performing predetermined display control on the first display member in an area corresponding to an area in which the second display member displays information, and when information which involves high rewriting responsiveness is displayed on the second display member and information which does not involve the high rewriting responsiveness is displayed on the first display member, the display control unit performs predetermined display control so that the area of the first display member corresponding to the area in which the second display member displays the high rewriting responsiveness information is displayed in black.

* * * * *